US009303649B2

(12) United States Patent
Ikeda et al.

(10) Patent No.: US 9,303,649 B2
(45) Date of Patent: Apr. 5, 2016

(54) CROSS FLOW FAN AND AIR-CONDITIONING APPARATUS INCLUDING SAME

(75) Inventors: Takashi Ikeda, Tokyo (JP); Takahide Tadokoro, Tokyo (JP); Shingo Hamada, Tokyo (JP); Mitsuhiro Shirota, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 423 days.

(21) Appl. No.: 13/876,561

(22) PCT Filed: Oct. 12, 2011

(86) PCT No.: PCT/JP2011/005717

§ 371 (c)(1),
(2), (4) Date: Mar. 28, 2013

(87) PCT Pub. No.: WO2012/063404

PCT Pub. Date: May 18, 2012

(65) Prior Publication Data

US 2013/0177395 A1 Jul. 11, 2013

(30) Foreign Application Priority Data

Nov. 8, 2010 (JP) ..... 2010-249511

(51) Int. Cl.
*B63H 1/26* (2006.01)
*B63H 5/07* (2006.01)
(Continued)

(52) U.S. Cl.
CPC ..... *F04D 17/04* (2013.01); *F01D 5/141* (2013.01); *F04D 29/281* (2013.01); *F04D 29/283* (2013.01); *F04D 29/30* (2013.01); *F24F 1/0025* (2013.01)

(58) Field of Classification Search
CPC ..... F04D 17/04; F04D 29/281
USPC ..... 416/178, 188
See application file for complete search history.

(56) References Cited

U.S. PATENT DOCUMENTS 6,086,324 A * 7/2000 Ikeda et al. ..... 415/53.1
6,692,223 B2 * 2/2004 Ikeda et al. ..... 415/53.1
2002/0172588 A1 11/2002 Ikeda et al.

FOREIGN PATENT DOCUMENTS

CN 1392940 A 1/2003
JP 59-1900 U 1/1984
(Continued)

OTHER PUBLICATIONS

Office Action dated Feb. 4, 2015 issued in corresponding CN Patent Application No. 201180053696.9 (and English translation).
(Continued)

*Primary Examiner* — Theresa Trieu
(74) *Attorney, Agent, or Firm* — Posz Law Group, PLC

(57) ABSTRACT

A cross flow fan including an impeller having at least two rings arranged with intervals in a fan rotation axis O direction and a plurality of blades that are arranged, between correlated rings, with intervals in a circumferential direction of the rings, in which the blade is divided into plural areas in the fan rotation axis O direction, and both ends adjacent to the rings are denoted as the blade-ring proximate sections and the center portion of the blade is denoted as the inter-blade-ring center section. The blade is formed such that the thickness of the inner peripheral blade end of the blade that is the inner peripheral end of the impeller is smaller in the inter-blade-ring center section than in the blade-ring proximate section.

18 Claims, 12 Drawing Sheets

(51) Int. Cl.

| | |
|---|---|
| ***B64C 11/16*** | (2006.01) |
| ***B64C 27/46*** | (2006.01) |
| ***F01D 5/14*** | (2006.01) |
| ***F03D 11/02*** | (2006.01) |
| ***F04D 17/04*** | (2006.01) |
| ***F04D 29/28*** | (2006.01) |
| ***F24F 1/00*** | (2011.01) |
| ***F04D 29/30*** | (2006.01) |

(56) References Cited

FOREIGN PATENT DOCUMENTS

| | | | | | |
|---|---|---|---|---|---|
| JP | 10-077988 | A | | 3/1998 | |
| JP | 2001-050556 | A | | 2/2001 | |
| JP | 2001-323891 | A | | 11/2001 | |
| JP | 2005-120877 | A | | 5/2005 | |
| JP | 2006-329099 | A | | 12/2006 | |
| JP | 2009133271 | A | * | 6/2009 | ..... F04D 17/04 |
| JP | 2011-099408 | A | | 5/2011 | |

OTHER PUBLICATIONS

Office Action mailed Mar. 4, 2014 in corresponding JP Patent Application No. 2013-054766 (with English translation).

Office Action mailed Jan. 22, 2013 in corresponding JP Patent Application No. 2010-249511 (with English translation).

International Search Report of the International Searching Authority mailed Jan. 17, 2012 for the corresponding international application No. PCT/JP2011/005717 (with English translation).

* cited by examiner

ARROW VIEW F

CROSS FLOW FAN AND AIR-CONDITIONING APPARATUS INCLUDING SAME

CROSS REFERENCE TO RELATED APPLICATIONS

This application is a U.S. national stage application of PCT/JP2011/005717 filed on Oct. 12, 2011, and claims priority to, and incorporates by reference, Japanese Patent Application No. 2010-249511 filed on Nov. 8, 2010.

TECHNICAL FIELD

The present invention relates to a cross flow fan and to an air-conditioning apparatus equipped with such a cross flow fan.

BACKGROUND ART

In conventional cross flow fans, there has been proposed, for example, a cross flow fan in which "the blade shape of the cross flow fan is configured with an arc-shaped portion defining a position of maximum thickness on the inner circumferential side of the blade, and in which a blade shape has a thickness distribution that gradually reduces its thickness towards the outer circumferential direction from the arc-shaped portion" with an object to "form a stable flow field even when a load is applied" (see Patent Literature 1, for example).

Furthermore, there has been proposed, for example, "a traverse fan in which a plurality of blades is arranged in a circumferential direction in an annual manner with a predetermined mounting pitch and is laterally fixed between a pair of discoid or circular end plates, and in which a partition plate is disposed in an intermediate portion of the blade in the axis direction", "the blade being formed such that the chord length in the intermediate portion in the axis direction is shorter than the chord length in the two end portions of the blade in the axis direction" with an object to "effectively lower fan noise without reducing air volume" (see Patent Literature 2, for example).

CITATION LIST

Patent Literature

[Patent Literature 1] Japanese Unexamined Patent Application Publication No. 2001-323891 (paragraphs [0007] and [0008], FIG. 1)

[Patent Literature 2] Japanese Unexamined Patent Application Publication No. 10-77988 (paragraphs [0009] and [0015], FIGS. 1 and 4)

SUMMARY OF INVENTION

Technical Problem

In the cross flow fan described in Patent Literature 1, a intermediate portion of a ring of the discoid blade mounting plate is not influenced by a boundary layer that develops on a surface of the ring; hence, suction and blowing out of air is facilitated.

However, because the blade has the same blade shape in the impeller shaft direction, the inter-blade distance is small, thus creating air flow resistance in the passage between the blades. As such, there has been a problem in that the fanning efficiency is deteriorated.

Further, owing to the deterioration of fanning efficiency, the power consumption of the fan motor driving the impeller increases. As such, there has been a problem in that the cross flow fan is inferior in energy efficiency.

Furthermore, in the cross flow fan described in Patent Literature 2, the blade chord length in the intermediate portion between the rings is formed smaller than the blade chord length in the portion close to the ring in order to reduce the air velocity in the intermediate portion between the rings and make the overall fan air velocity distribution in the shaft direction uniform.

However, because the chord length is made short in the area where it is easier for the air to flow through, such as the intermediate portion between the rings where there is no obstacles such as a ring, there has been a problem in that the blast volume drops.

That is, because the air velocity distribution in the impeller shaft direction is made uniform by reducing the pressure rise in the blades, there has been a problem in that the fanning efficiency deteriorates.

Further, owing to the deterioration of fanning efficiency, the power consumption of the fan motor driving the impeller increases. As such, there has been a problem in that the cross flow fan is inferior in energy efficiency.

The invention is addressed to overcome the problems described above and provides a cross flow fan that is capable of reducing the air flow resistance in the passage between the blades, as well as an air-conditioning apparatus equipped with this cross flow fan.

Further, the invention provides a cross flow fan that is capable of making the air velocity distribution of the impeller uniform, as well as an air-conditioning apparatus equipped with this cross flow fan.

Furthermore, the invention provides a cross flow fan that is capable of reducing air flow resistance in the impeller and the air passage and that is capable of improving fanning efficiency, as well as an air-conditioning apparatus equipped with this cross flow fan.

Additionally, the invention provides a cross flow fan that is capable of suppressing increase in power consumption of the fan motor driving the impeller and that is capable of improving energy efficiency, as well as an air-conditioning apparatus equipped with this cross flow fan.

Solution to Problem

The cross flow fan according to the invention includes an impeller having at least two support plates arranged with intervals in a rotation axis direction; and a plurality of blades arranged between correlated support plates, the blades being arranged with intervals in a circumferential direction of the support plates, in which each blade between the support plates is divided into a plurality of areas in the rotation axis direction such that both ends adjacent to the support plates are a first area and a center portion of the blade is a second area, and a thickness of an inner peripheral blade end that is an end of a blade on an inner-circumferential side of the impeller is formed such that the second area is smaller in thickness than the first area The air-conditioning apparatus according to the invention includes the above described cross flow fan; and an heat exchanger disposed in a suction-side passage formed by the cross flow fan, the heat exchanger being configured to exchange heat with sucked-in air.

Advantageous Effects of Invention

In the invention, the thickness of the inner peripheral blade end of the blade is formed smaller in the second region, which is the middle portion, than in the first region, which is adjacent to the support plate; hence, it is possible to reduce the air flow resistance in each passage between the blades.

Further, it is possible to make the air velocity distribution of the impeller uniform.

Furthermore, it is possible to reduce the air flow resistance in the impeller and the air passage, thus improve fanning efficiency.

Moreover, it is possible to suppress increase in power consumption of the fan motor driving the impeller, thus improve energy efficiency.

DESCRIPTION OF EXEMPLARY EMBODIMENTS

First Exemplary Embodiment

Figure 1:
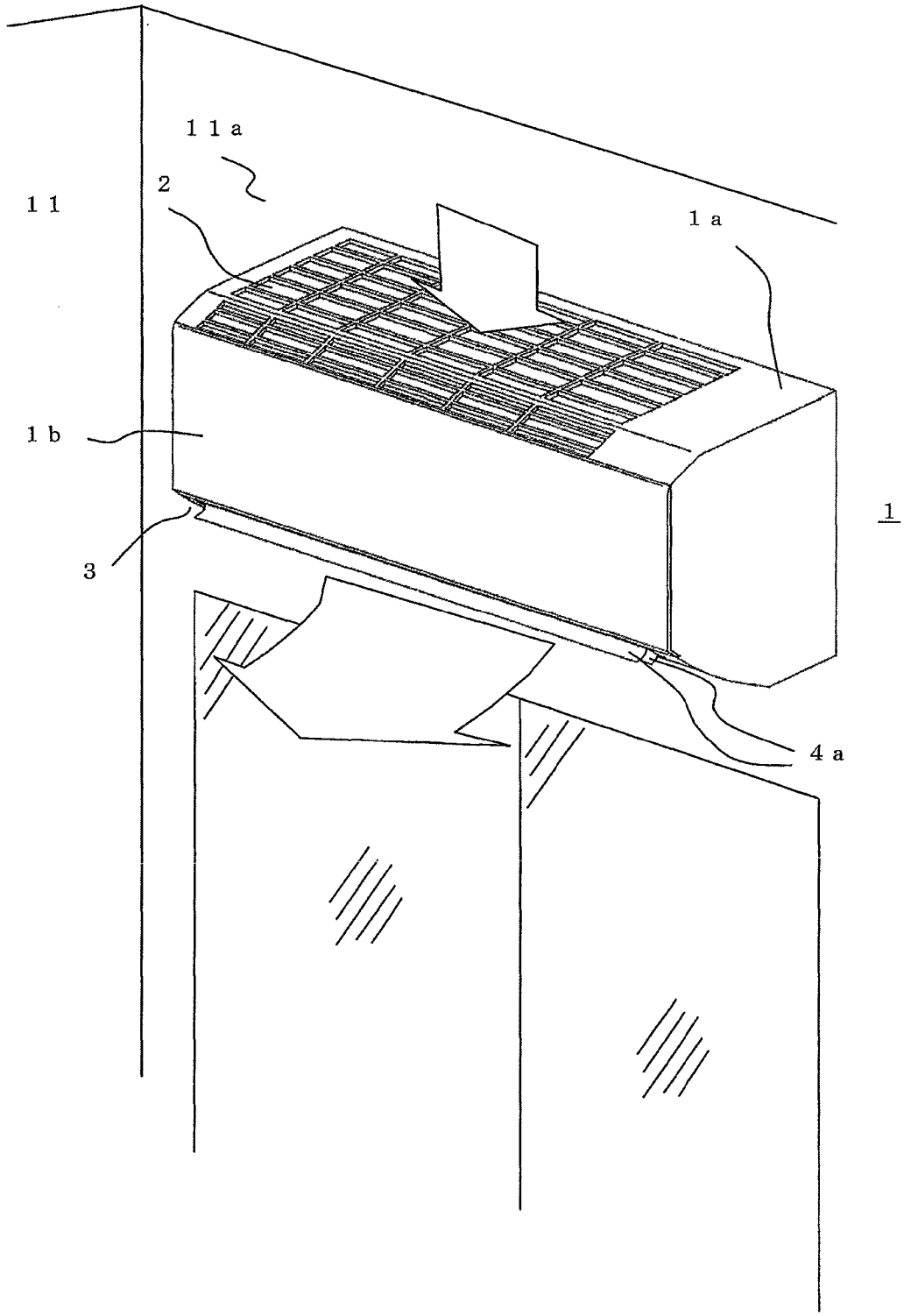
FIG. 1 is an external perspective view of an air-conditioning apparatus according to Embodiment 1 of the invention.

FIG. 1 is an external perspective view of an air-conditioning apparatus according to Embodiment 1 of the invention.

Figure 2:
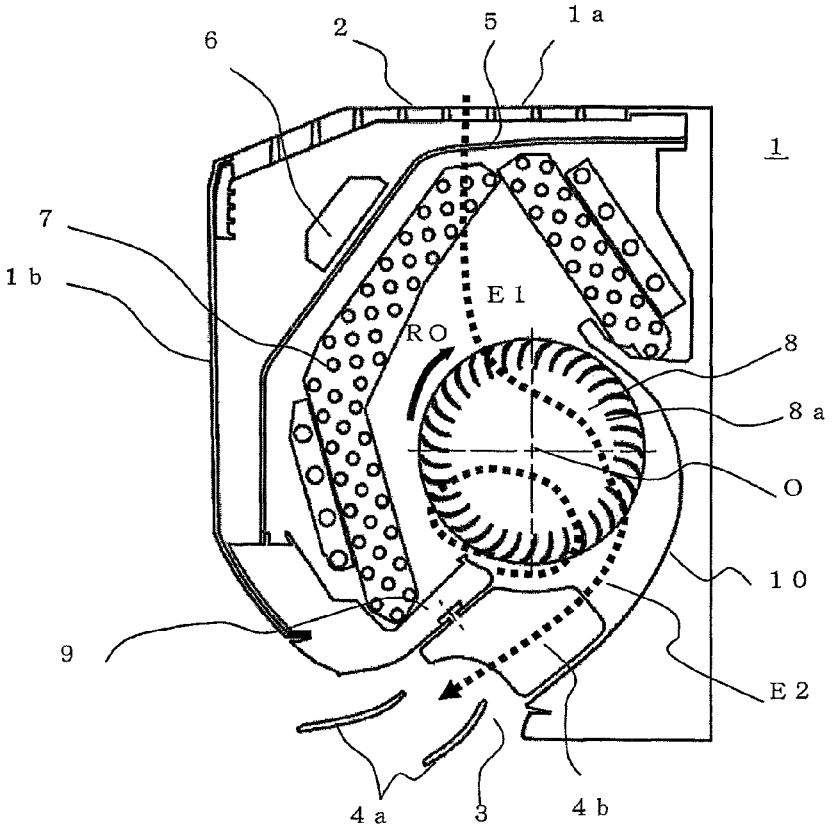
FIG. 2 is a longitudinal sectional view of the air-conditioning apparatus of FIG. 1.

FIG. 2 is a longitudinal sectional view of the air-conditioning apparatus of FIG. 1.

Referring to FIGS. 1 and 2, an air-conditioning apparatus body 1 according to the invention is disposed on a wall 11*a* of a room 11 to be air-conditioned.

Further, a detachable front grille 6 is attached to a body front 1*a*.

Furthermore, an upper inlet port 2, a filter 5 that carries out dust removal of dust, and a heat exchanger 7 that carries out cooling/heating by exchanging heat with air suctioned into the body are arranged in the body upper portion 1*b*.

A cross flow fan 8 that is an air-sending device is arranged on the downstream side of the heat exchanger 7.

The cross flow fan 8 includes an impeller 8*a*; a stabilizer 9 having a tongue portion, which separates a suction side flow path E1 and a discharge side flow path E2, and a drain pan, which temporarily stores water droplets dripping from the heat exchanger 7; and a helical guide wall 10 on the discharge side of the impeller 8*a*.

Furthermore, air direction vanes (vertical wind direction vanes 4*a* and horizontal wind direction vanes 4*b*) are rotatably attached to the air outlet 3.

Figure 3:
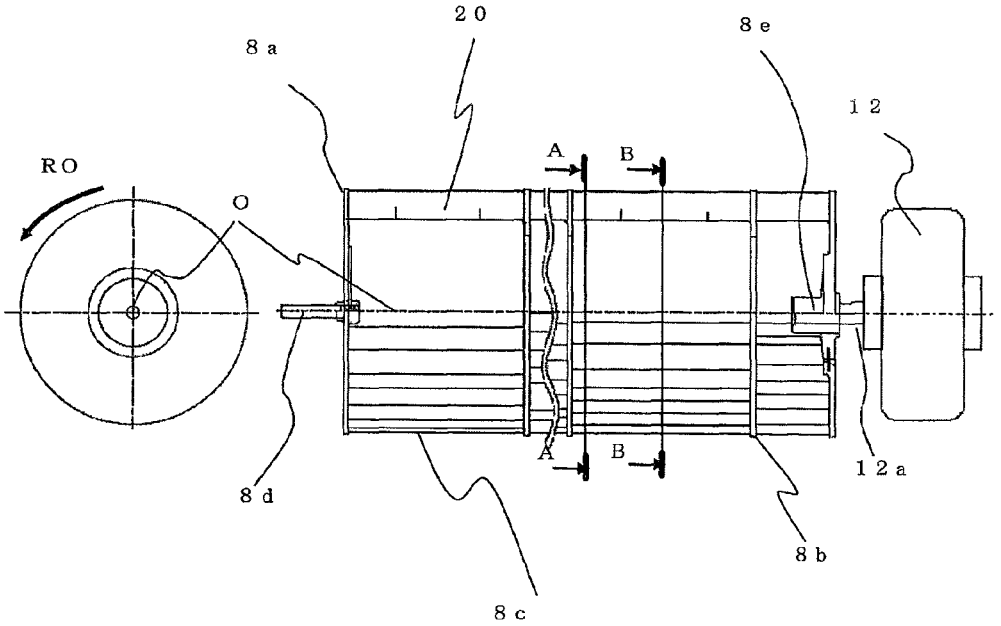
FIG. 3 is a front view of an impeller of a cross flow fan of FIG. 1.

FIG. 3 is a front view of the impeller of the cross flow fan of FIG. 1.

Referring to FIG. 3, the impeller 8*a* of the cross flow fan 8 is, as an example, formed of thermoplastic resin such as AS resin.

The impeller 8*a* is integrally formed by welding and connecting a plurality of impeller units 8*c* that includes a plurality of blades 20 that extends from the outer circumference of a disk-shaped ring 8*b* and that is consecutively installed in the circumferential direction of the ring 8*b*.

That is, the plurality of blades 20 that are arranged with intervals in the circumferential direction of the rings 8*b* are provided between the correlated rings 8*b* of the impeller unit 8*c*.

Furthermore, the impeller 8*a* sends air by moving rotationally in a fan rotation direction RO with a fan rotation axis O at its center while the two ends are in a supported state such that one end is secured to a fan shaft 8*d* and the other end is secured by a screw and the like to a fan boss 8*e*, which protrudes into the internal side of the impeller 8*a*, and a motor shaft 12*a* of a motor 12.

Note that the "ring 8*b*" corresponds to a "support plate" of the invention.

Note that, in Embodiment 1, although the impeller 8*a* is formed by connecting a plurality of impeller units 8*c*, the invention is not limited to this and the impeller 8*a* may be constituted by an impeller unit 8*c* alone.

Note that, in Embodiment 1, although disk-shaped rings 8*b* are used, the invention is not limited to this. For example, polygonal support plates may be used.

Figure 4:
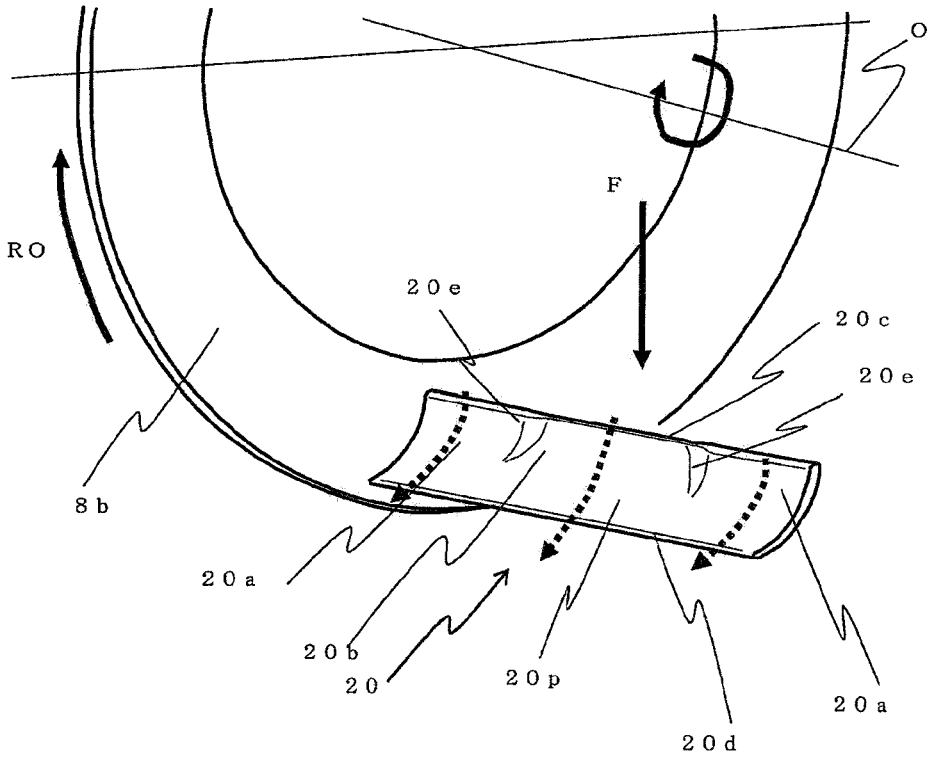
FIG. 4 is a perspective view of a single blade of FIG. 3 seen from a blade pressure surface side (rotation direction side).

FIG. 4 is a perspective view of a single blade of FIG. 3 seen from a blade pressure surface side (rotation direction side).

Figure 5:
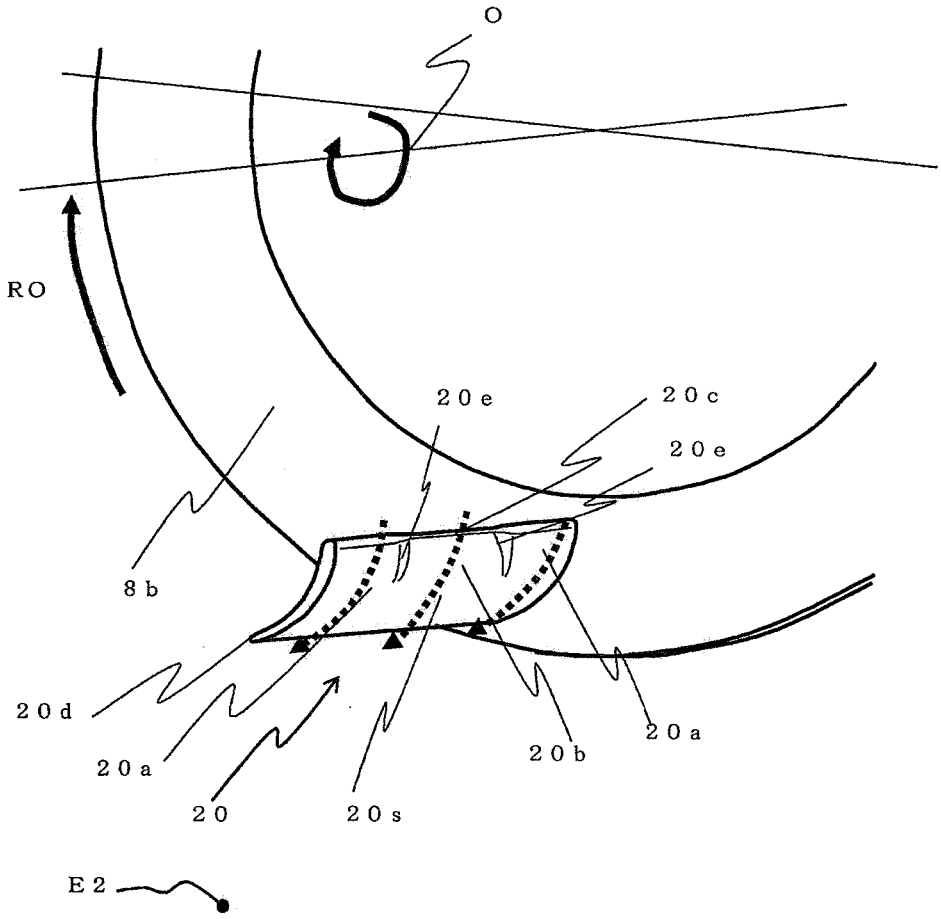
FIG. 5 is a perspective view of the single blade of FIG. 3 seen from a blade suction pressure surface side (opposite the rotation direction side).

FIG. 5 is a perspective view of the single blade of FIG. 3 seen from a blade suction pressure surface side (opposite the rotation direction side).

Figure 6:
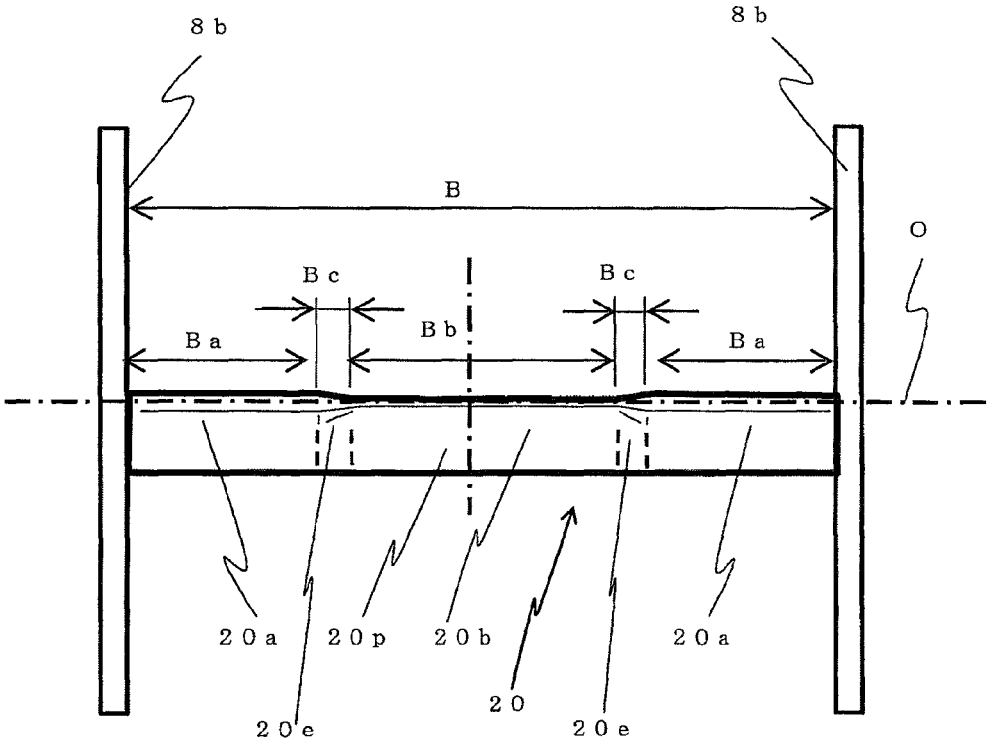
FIG. 6 is an arrow view of the single blade of FIG. 4 taken from the direction of arrow F seen from an inner circumferential side of the fan.

FIG. 6 is an arrow view taken from the direction of arrow F showing the single blade of FIG. 4 from an inner circumferential side of the fan.

Referring to FIGS. 4 to 6, the blade 20 is formed with a shape in which its outer peripheral blade end 20*d*, which is the outer peripheral end of the impeller 8*a*, is tilted forward in the fan rotation direction RO relative to its inner peripheral blade end 20*c*, which is the inner peripheral end of the impeller 8*a*.

The blade 20 is divided into plural areas in the rotation axis direction such that five areas are formed, namely, blade-ring proximate sections 20*a* that are both end portions adjacent to the rings 8*b*, inter-blade-ring center section 20*b* that is the center portion of the blade 20, and blade connection sections 20*e* that are areas between the blade-ring proximate sections 20*a* and the inter-blade-ring center section 20*b*.

Note that the "blade-ring proximate sections 20*a*" corresponds to a "first area" of the invention.

Note that the "inter-blade-ring center section 20*b*" corresponds to a "second area" of the invention.

Note that the "blade connection sections 20*e*" corresponds to a "third area" of the invention.

Regarding the thickness of the inner peripheral blade end 20*c* of the blade 20, the inter-blade-ring center section 20*b* is formed thinner than the blade-ring proximate sections 20*a*.

Furthermore, the thickness of the blade 20 in the blade connection sections 20*e* is formed to gradually change in shape from the thickness of the blade-ring proximate sections 20*a* to the thickness of the inter-blade-ring center section 20*b*.

That is, the inner peripheral blade end 20*c* of the blade 20 is formed such that both a blade pressure surface 20*p*, which is the front surface of the blade 20 with respect to the fan rotation direction RO, and a blade suction pressure surface 20*s*, which is the rear surface with respect to the fan rotation direction RO, are dented in the inter-blade-ring center section 20*b* for a predetermined length in the fan rotation axis O direction.

Furthermore, as shown in FIG. 6, in an inter-blade-ring length B that is the total length of the blade 20 in the fan rotation axis O direction, a length Bb of the inter-blade-ring center section 20*b* in the fan rotation axis O direction, each length Ba of the two blade-ring proximate sections 20*a* at both ends in the fan rotation axis O direction, and each length Bc of the two blade connection sections 20*e* in the fan rotation axis O direction hold a relationship of Bb>Ba>Bc.

Figure 7:
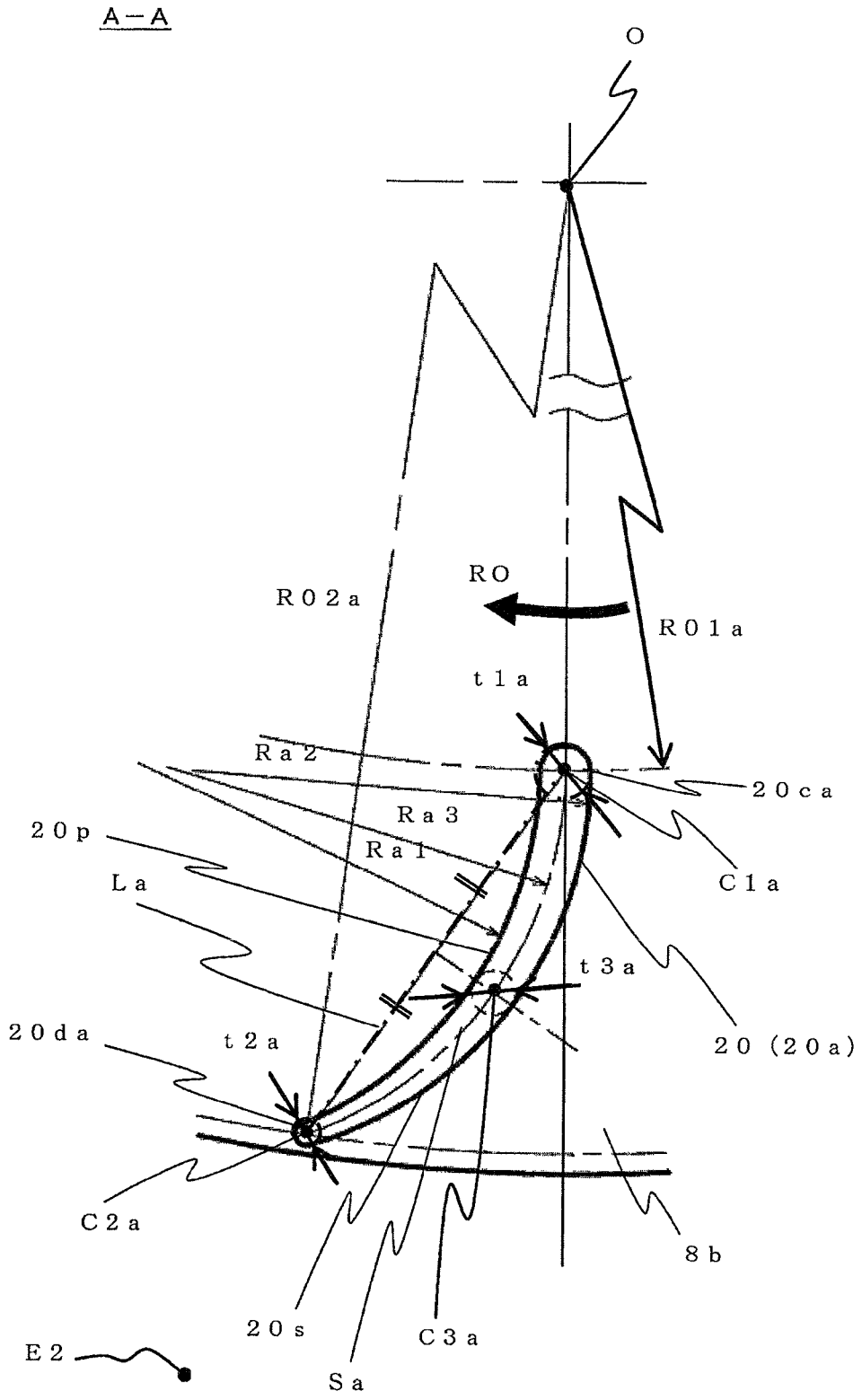
FIG. 7 is a cross-sectional view of the single blade of FIG. 3 taken along the line A-A.

FIG. 7 is a cross-sectional view taken along the line A-A of the single blade of FIG. 3.

Referring to FIG. 7, a section of a blade-ring proximate section 20*a* that is orthogonal to the fan rotation axis O is shown.

As shown in FIG. 7, the blade 20 is formed such that its section orthogonal to the fan rotation axis O has an arc shape.

An outer peripheral blade end 20*da* and an inner peripheral blade end 20*ca* in the blade-ring proximate section 20*a* of the blade 20 are both formed into an arc shape. Further, the outer peripheral blade end 20*da* is positioned on the inner circumferential side relative to the outer circumference of the ring 8*b*.

Furthermore, the thickness of the blade 20 in the blade-ring proximate section 20*a* is formed to gradually increase from the outer peripheral blade end 20*da* to the inner peripheral blade end 20*ca*.

That is, when t1*a* is the thickness at an arc center point C1*a* of the inner peripheral blade end 20*ca* in the blade-ring proximate section 20*a*, t2*a* is the thickness at an arc center point C2*a* of the outer peripheral blade end 20*da*, and t3*a* is the thickness at the chord center point C3*a* (described later), the thickness in the blade-ring proximate section 20*a* is formed such that: thickness t2*a* of the outer peripheral blade end 20*da*<thickness t3*a* at the chord center point C3*a*<thickness t1*a* of the inner peripheral blade end 20*ca*.

Here, the thickness t1*a* of the inner peripheral blade end 20*ca* corresponds to the diameter of a circle that inscribes the arc of the inner peripheral blade end 20*ca*.

Further, the thickness t2*a* of the outer peripheral blade end 20*da* corresponds to the diameter of a circle that inscribes the arc of the outer peripheral blade end 20*da*.

Furthermore, when a chord line La is the line connecting the arc center point C2*a* of the outer peripheral blade end 20*da* and the arc center point C1*a* of the inner peripheral blade end 20*ca*, the thickness t3*a* at the chord center point C3*a* corresponds to the diameter of a circle inscribing the blade 20 at the chord center point C3*a* that is an intersection point between a perpendicular bisector of this chord line La and a camber line Sa that is the center line of thickness of the blade 20 in the blade-ring proximate section 20*a*.

The blade pressure surface 20*p*, the camber line Sa, and the blade suction pressure surface 20*s* are each formed into an arc shape in a section of the blade-ring proximate section 20*a* orthogonal to the fan rotation axis O.

Furthermore, when Ra1 is the arc radius of the blade pressure surface 20*p*, Ra2 is the arc radius of the blade suction pressure surface 20*s*, and Ra3 is the arc radius of the camber line Sa, then, the blade 20 is formed such that: the arc radius Ra1 of the blade pressure surface 20*p*<the arc radius Ra3 of the camber line Sa<the arc radius Ra2 of the blade suction pressure surface 20*s*.

That is, the arc radius Ra1 of the blade pressure surface 20*p* is formed so as to be smaller than the arc radius Ra2 of the blade suction pressure surface 20*s*, and the blade 20 is shaped such that the arc radius becomes smaller and the curvature becomes tighter the more on the blade pressure surface 20*p* side.

Note that in FIG. 7, R01*a* is the radius of a circle that is centered around the fan rotation axis O and that passes through the arc center point C1*a* of the inner peripheral blade end 20*ca* in the blade-ring proximate section 20*a*.

Furthermore, R02*a* is the radius of a circle that is centered around the fan rotation axis O and that passes through the arc center point C2*a* of the outer peripheral blade end 20*da* in the blade-ring proximate section 20*a*.

Figure 8:
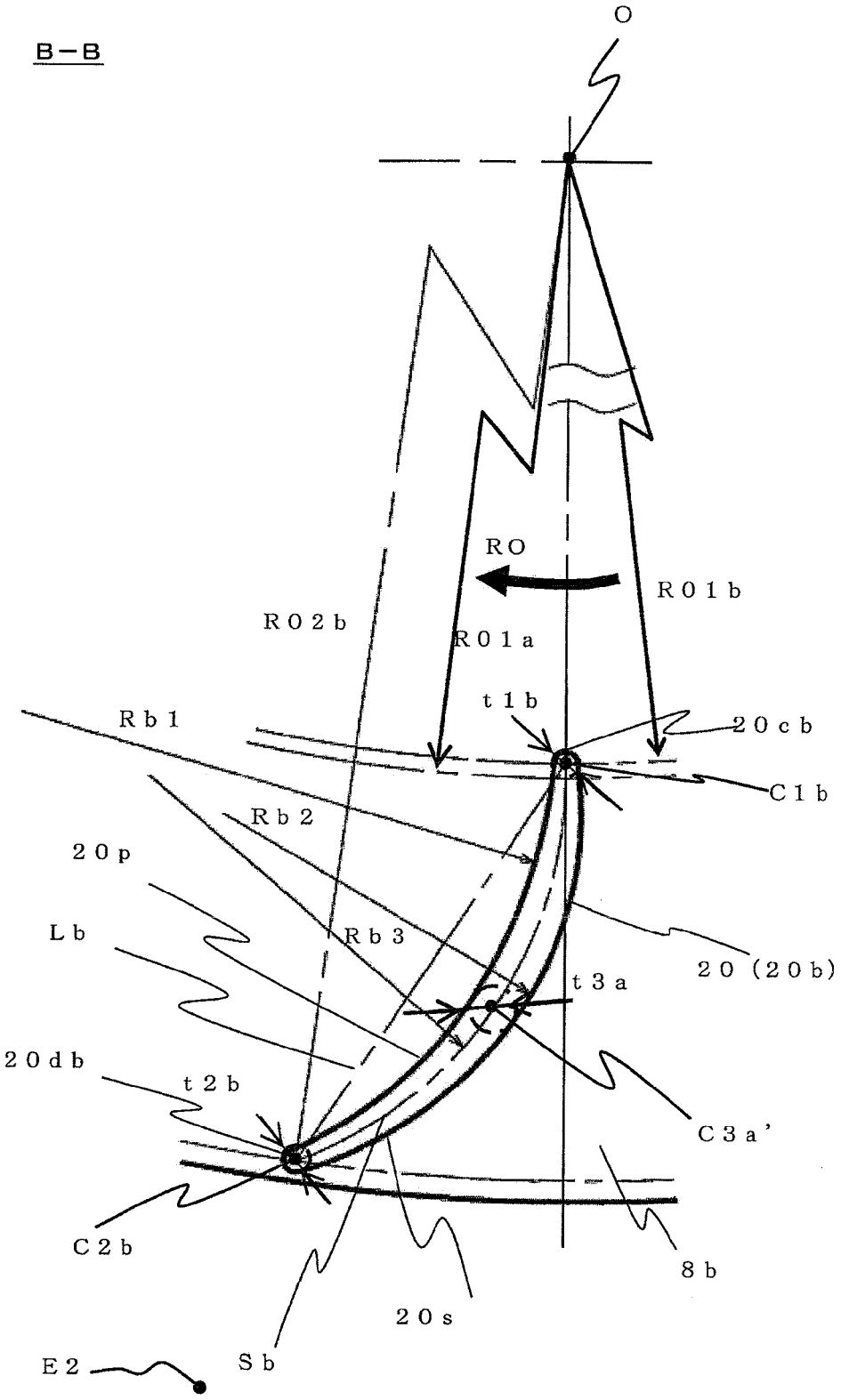
FIG. 8 is a cross-sectional view of the single blade of FIG. 3 taken along the line B-B.

FIG. 8 is a cross-sectional view of the single blade of FIG. 3 taken along the line B-B.

Referring to FIG. 8, a section of the inter-blade-ring center section 20*b* that is orthogonal to the fan rotation axis O is shown.

As shown in FIG. 8, the blade 20 is formed such that its section orthogonal to the fan rotation axis O is an arc shape.

An outer peripheral blade end 20*db* and an inner peripheral blade end 20*cb* in the inter-blade-ring center section 20*b* of the blade 20 are both formed into an arc shape. Further, the outer peripheral blade end 20*db* is positioned on the inner circumferential side relative to the outer circumference of the ring 8*b*.

Furthermore, the thickness of the blade 20 in the inter-blade-ring center section 20*b* is formed to gradually increase from the outer peripheral blade end 20*db* to the middle of the outer peripheral blade end 20*db* and the inner peripheral blade end 20*cb* and to gradually decrease from this middle portion to the inner peripheral blade end 20*cb*.

That is, when t1*b* is the thickness at an arc center point C1*b* of the inner peripheral blade end 20*cb* in the inter-blade-ring center section 20*b*, t2*b* is the thickness at an arc center point C2*b* of the outer peripheral blade end 20*db*, and t3*a* is the thickness at the chord center point C3*a*' (described later), the thickness of the blade 20 in the inter-blade-ring center section 20*b* is formed, for example, such that: thickness t2*b* of the outer peripheral blade end 20*db*<the thickness t3*a* at the chord center point C3*a*', and, the thickness t3*a* at the chord center point C3*a*'>thickness t1*b* of the inner peripheral blade end 20*cb*.

Here, the thickness t1*b* of the inner peripheral blade end 20*cb* corresponds to the diameter of a circle that inscribes the arc of the inner peripheral blade end 20*cb*.

Further, the thickness t2*b* of the outer peripheral blade end 20*db* corresponds to the diameter of a circle that inscribes the arc of the outer peripheral blade end 20*db*.

Furthermore, the chord center point C3*a*' is a projected point of the chord center point C3*a* in the section of FIG. 7 taken along the line A-A onto the section taken along the line B-B. The thickness t3*a* at the chord center point C3*a*' corresponds to the diameter of a circle inscribing the blade 20 at the chord center point C3*a*' and is the same as the thickness t3*a* at the chord center point C3*a* in the section of FIG. 7 taken along the line A-A.

Note that although in Embodiment 1, a case is given in which the thickness t3*a* at the chord center point C3*a*', which is a projected point of the chord center point C3*a* in the section of FIG. 7 taken along the line A-A onto the section taken along the line B-B, is the thickest and the thickness is the same as that of the section taken along the line A-A, the invention is not limited to this case.

Note that in FIG. 8, Lb is a chord line connecting the arc center point C2*b* of the outer peripheral blade end 20*db* and the arc center point C1*b* of the inner peripheral blade end 20*cb*.

Further, Sb is a camber line that is the center line of thickness of the blade 20 in the inter-blade-ring center section 20*b*.

Further, R01*b* is the radius of a circle that is centered around the fan rotation axis O and that passes through the arc center point C1*b* of the inner peripheral blade end 20*cb* in the inter-blade-ring center section 20*b*.

Furthermore, R02*b* is the radius of a circle that is centered around the fan rotation axis O and that passes through the arc center point C2*b* of the outer peripheral blade end 20*db* in the inter-blade-ring center section 20*b*.

The blade pressure surface 20*p*, the camber line Sb, and the blade suction pressure surface 20*s* are each formed into an arc shape in a section of the inter-blade-ring center section 20*b* orthogonal to the fan rotation axis O.

Furthermore, when Rb1 is the arc radius of the blade pressure surface 20*p*, Rb2 is the arc radius of the blade suction pressure surface 20*s*, and Rb3 is the arc radius of the camber line Sb that is the center line of thickness of the blade 20 in the inter-blade-ring center section 20*b*, then, the blade 20 is formed such that: the arc radius Rb1 of the blade pressure surface 20*p*>the arc radius Rb3 of the camber line Sb>the arc radius Rb2 of the blade suction pressure surface 20*s*.

That is, the arc radius Rb1 of the blade pressure surface 20*p* is formed so as to be larger than the arc radius Rb2 of the blade suction pressure surface 20*s*, and the blade 20 is shaped such that the arc radius becomes smaller and the curvature becomes tighter the more on the blade suction pressure surface 20*s* side.

Figure 9:
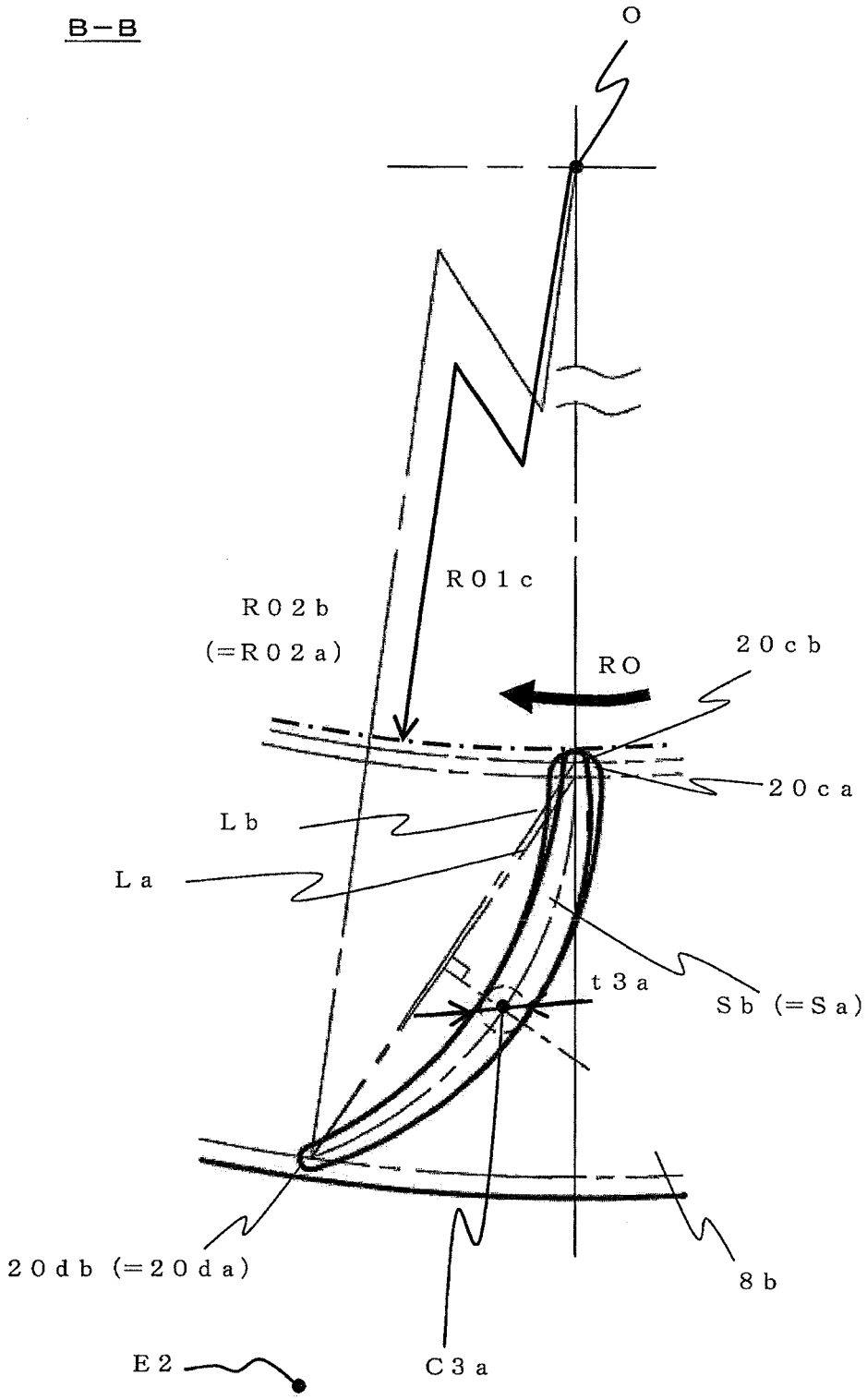
FIG. 9 is a cross-sectional view of the single blade of FIG. 3 taken along the line B-B.

FIG. 9 is a cross-sectional view of the single blade of FIG. 3 taken along the line B-B.

Referring to FIG. 9, a shape of the blade-ring proximate section 20*a* is shown, as well as a section of the inter-blade-ring center section 20*b* that is orthogonal to the fan rotation axis O.

As shown in FIG. 9, the blade 20 is formed such that the shapes of the blade-ring proximate section 20*a* and the inter-blade-ring center section 20*b* are the same from the outer peripheral blade end 20*d* to the middle of the outer peripheral blade end 20*d* and the inner peripheral blade end 20*c*.

Furthermore, the blade 20 is formed such that the shapes of the blade-ring proximate section 20*a*, the inter-blade-ring center section 20*b*, and the blade connection sections 20*e* vary from the middle of the outer peripheral blade end 20*d* and the inner peripheral blade end 20*c* to the inner peripheral blade end 20*c*.

For example, the shape of each section is formed so as to be the same from the outer peripheral blade end 20*d* to the chord center point C3*a*, and the shape of each section is formed so as to vary from the chord center point C3*a* to the inner peripheral blade end 20*c*.

Furthermore, R01*c* is a radius of a circle that is centered around the fan rotation axis O and that passes through an end face of the inner peripheral blade end 20*cb* in the inter-blade-ring center section 20*b*. R01*c* is the same as the radius of a circle that is centered around the fan rotation axis O and that passes through an end face of the inner peripheral blade end 20*ca* in the blade-ring proximate section 20*a*.

Moreover, the blade 20 is formed such that the camber line Sa, which is the center line of thickness of the blade 20 in the blade-ring proximate section 20*a*, and the camber line Sb, which is the center line of thickness in the inter-blade-ring center section 20*b*, are the same.

Figure 10:
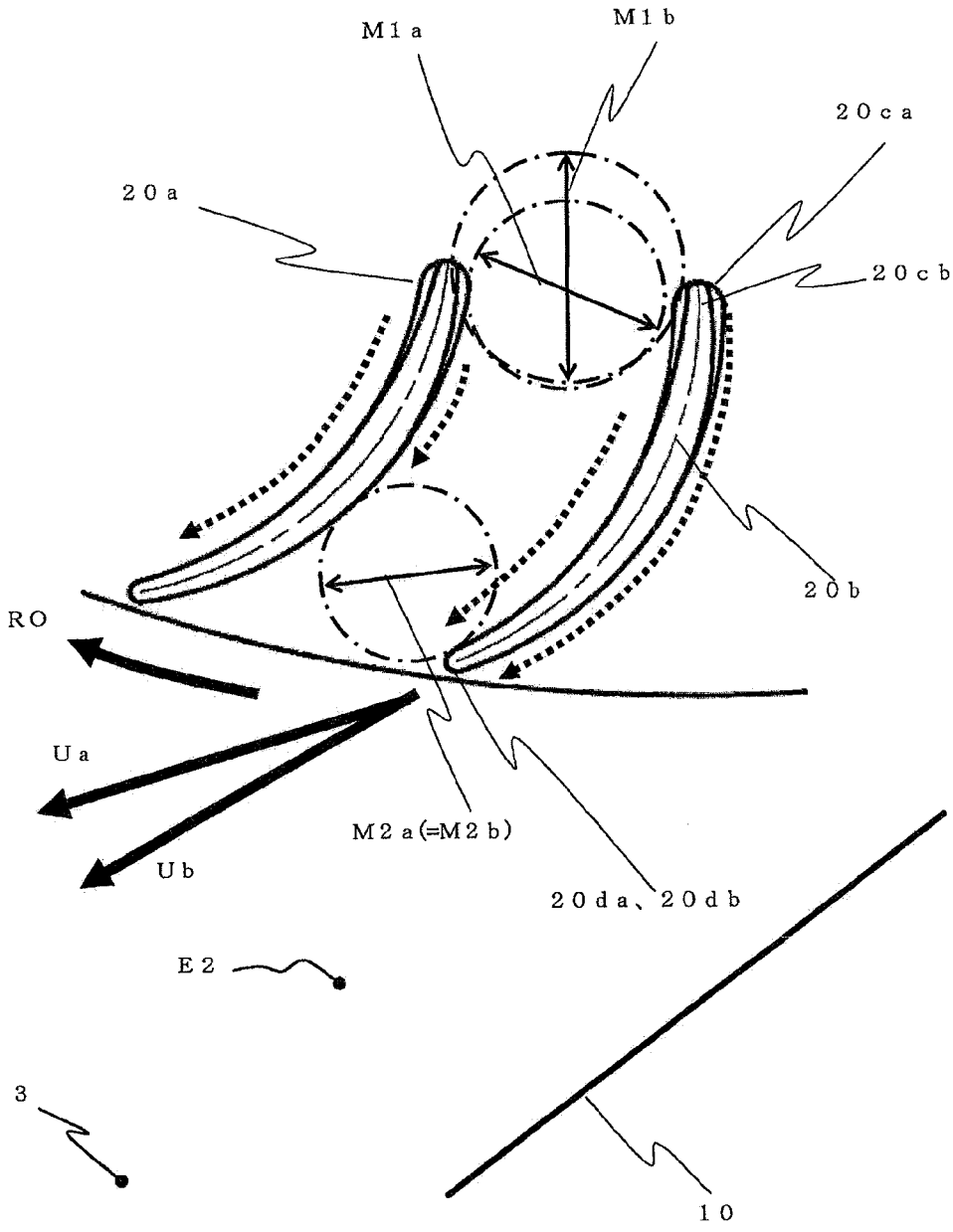
FIG. 10 is an enlarged view of a cross-sectional view of a plurality of blades of FIG. 3 on the fan outlet side taken along the line A-A.

FIG. 10 is an enlarged view of a cross-sectional view of the plurality of blades of FIG. 3 on the fan outlet side taken along the line A-A.

As shown in FIG. 10, when a distance between the adjacent blades 20 is depicted by the diameter of a circle that inscribes the surface of each of the respective blades 20, then M1*a*<M1*b*, where M1*b* is an inter-blade distance between the inner peripheral blade ends 20*cb* in the inter-blade-ring center section 20*b* and M1*a* is an inter-blade distance between the inner peripheral blade ends 20*ca* in the blade-ring proximate section 20*a*. That is, the inter-blade distance in the inter-blade-ring center section 20*b* is greater than that in the blade-ring proximate section 20*a*.

Further, the inter-blade distance M2*a* between the outer peripheral blade ends 20*da* in the blade-ring proximate section 20*a* is the same as the inter-blade distance M2*b* between the outer peripheral blade ends 20*db* in the inter-blade-ring center section 20*b*.

Furthermore, the inter-blade distances M2*a* and M2*b* between the outer peripheral blade ends 20*da* and 20*db*, respectively, are at least formed smaller than the inter-blade distances M1*a* and M1*b* between the inner peripheral blade ends 20*ca* and 20*cb*, respectively.

Note that in FIG. 10, Ua depicts a blowout flow from the blade-ring proximate section 20*a*. Furthermore, Ub depicts a blowout flow from the inter-blade-ring center section 20*b*.

As described above, in Embodiment 1, the blade 20 is divided into plural areas in the fan rotation axis O direction, and both ends adjacent to the rings 8*b* are denoted as the blade-ring proximate sections 20*a* and the center portion of the blade 20 is denoted as the inter-blade-ring center section 20*b*. The blade 20 is formed such that the thickness of the inner peripheral blade end 20*c* of the blade 20 that is the inner peripheral end of the impeller 8*a* is smaller in the inter-blade-ring center section 20*b* than in the blade-ring proximate section 20*a*.

Accordingly, the inter-blade distance M1*b* between the inner peripheral blade ends 20*cb* in the inter-blade-ring center section 20*b* is greater than the inter-blade distance M1*a* between the inner peripheral blade ends 20*ca* in the blade-ring proximate section 20*a*. Therefore, it is possible to blow out air in the fan-blow-out region such that the velocity of air passing between the blades is lower in the inter-blade-ring center section 20*b* than in the blade-ring proximate section 20*a*.

As a result, it is possible to uniformize the air velocity distribution in the fan-blow-out region in the fan rotation axis O direction, reduce the air flow resistance in the blow-out passage, and reduce power consumption of the fan motor. Hence, energy efficiency can be improved.

Furthermore, since the thickness of the inner peripheral blade ends 20*ca* is large in the blade-ring proximate section 20*a*, the inter-blade distance M1*b* between the inner peripheral blade ends 20*cb* is small.

Accordingly, even if a boundary-layer turbulent flow that develops on the surface of the ring 8*b* flows in, the flow is accelerated in the blade-ring proximate section 20*a* and is blown out to the fan blow out side.

That is, it is possible to reduce noise by reducing the turbulence and the air velocity of the flow flowing into the blade 20.

Furthermore, in Embodiment 1, the areas between the blade-ring proximate sections 20*a* and the inter-blade-ring center section 20*b* are referred to as the blade connection sections 20*e* and the thickness of the blade 20 in the blade connection sections 20*e* is formed to gradually change in shape from the thickness of the blade-ring proximate sections 20*a* to the thickness of the inter-blade-ring center section 20*b*.

Accordingly, it is possible to blow out air while seamlessly reducing the velocity of air passing between the blades.

As a result, it is possible to uniformize the air velocity distribution in the fan-blow-out region in the fan rotation axis O direction, reduce the air flow resistance in the blow-out passage, and reduce power consumption of the fan motor. Hence, energy efficiency can be improved.

Further, in Embodiment 1, the thickness of the blade 20 in the blade-ring proximate section 20*a* is formed to gradually increase from the outer peripheral blade end 20*da* to the inner peripheral blade end 20*ca*. Furthermore, the thickness of the blade 20 in the inter-blade-ring center section 20*b* is formed to gradually increase from the outer peripheral blade end 20*d* to the middle of the outer peripheral blade end 20*d* and the inner peripheral blade end 20*c* and to gradually decrease from the middle portion to the inner peripheral blade end 20*c*.

Accordingly, even if a boundary-layer turbulent flow that develops on the surface of the ring 8*b* flows in, since the inter-blade distance M1*a* is small, the turbulence is seamlessly attenuated and is blown out to the fan blow out side. That is, noise can be reduced by reducing the turbulence and the air velocity of the flow flowing into the blade 20.

Furthermore, the inter-blade-ring center section 20*b* can blow out air while further reducing the velocity of air passing between the blades.

As a result, it is possible to uniformize the air velocity distribution in the fan-blow-out region in the fan rotation axis O direction, reduce the air flow resistance in the blow-out passage, and reduce power consumption of the fan motor. Hence, energy efficiency can be improved.

Further, in Embodiment 1, the blade 20 is formed such that its section orthogonal to the fan rotation axis O is an arc shape, and when the chord center point C3*a* is referred to as the intersection point between the perpendicular bisector of the chord line, which connects the outer peripheral blade end 20*d* and the inner peripheral blade end 20*c*, and the center of thickness of the blade 20, then the thickness of the blade 20 in the blade-ring proximate section 20*a* is formed such that: thickness of the outer peripheral blade end 20*d*<thickness at the chord center point C3*a*<thickness of the inner peripheral blade end 20*c*. Furthermore, the thickness of the blade 20 in the inter-blade-ring center section 20*b* is formed such that: thickness of the outer peripheral blade end 20*d*<the thickness at the chord center point C3*a*, and, the thickness at the chord center point C3*a*>thickness of the inner peripheral blade end 20*c*.

Accordingly, even if a boundary-layer turbulent flow that develops on the surface of the ring 8*b* flows in, since the inter-blade distance M1*a* is small, the turbulence is seamlessly attenuated and is blown out to the fan blow out side. That is, noise can be reduced by reducing the turbulence and the air velocity of the flow flowing into the blade 20.

Furthermore, the inter-blade-ring center section 20*b* can blow out air while further reducing the velocity of air passing between the blades.

As a result, it is possible to uniformize the air velocity distribution in the fan-blow-out region in the fan rotation axis O direction, reduce the air flow resistance in the blow-out passage, and reduce power consumption of the fan motor. Hence, energy efficiency can be improved.

Further, in Embodiment 1, the arc radius of the blade pressure surface 20*p*, which is the front surface of the blade 20 with respect to the fan rotation direction RO, is formed so as to be smaller than the arc radius of the blade suction pressure surface 20*s*, which is the rear surface of the blade 20 with respect to the fan rotation direction RO, in the blade-ring proximate section 20*a*, and the arc radius of the blade pressure surface 20*p* is formed so as to be larger than the arc radius of the blade suction pressure surface 20*s* in the inter-blade-ring center section 20*b*.

Accordingly, in the inter-blade-ring center section 20*b* where volume of air passing therethrough is large, it is possible to reduce the deflection angle of the flow in the blade pressure surface 20*p*.

Furthermore, in the blade-ring proximate section 20*a* where volume of air passing therethrough is small, it is possible to increase the deflection angle of the flow in the blade pressure surface 20*p*.

That is, as illustrated in FIG. 10, the blowout flow Ub from the inter-blade-ring center section 20*b* blows out to the guide wall 10 side from the middle of the height direction of the air outlet 3.

Moreover, the blowout flow Ua from the blade-ring proximate section 20*a* blows out to the stabilizer 9 side and into a portion above the blowout flow Ub from the middle of the height direction of the air outlet 3.

As a result, in the fan rotation axis O direction, it is possible to blow out air to different directions in the height direction of the air outlet 3. As such, the high-velocity region is diffused, drift is suppressed, the air velocity distribution is uniformized, and thus, air flow resistance is reduced.

Accordingly, it is possible to lower the air flow resistance in the air passage and reduce the power consumption of the fan motor. Hence, energy efficiency can be improved.

Further, in Embodiment 1, in each area of the blade 20, the shape of the section orthogonal to the fan rotation axis O is formed such that the shape in each area is the same from the outer peripheral blade end 20*d* to the middle of the outer peripheral blade end 20*d* and the inner peripheral blade end 20*c*. Furthermore, each area is formed so that the shape varies from the middle of the outer peripheral blade end 20*d* and the inner peripheral blade end 20*c* to the inner peripheral blade end 20*c*.

Accordingly, adherence of dust to the blade 20 can be suppressed. That is, if there is, on the outer peripheral side of the impeller 8*a* in the fan rotation axis O direction, a shape-changed portion, such as, for example, waviness or notches in the thickness or the outer peripheral blade end 20*d*, then there are cases in which the floating dust around the fan is stuck in the shape-changed portion when the cross flow fan 8 is activated, becoming a beginning of adhesion and sticking of dust onto the blade 20. In Embodiment 1, adhesion of dust can be suppressed since the blade 20 from the middle to the inner peripheral blade end 20*c* is formed to vary its shape.

Accordingly, cleanliness of the cross flow fan 8 can be maintained. As a result, a sanitary air-conditioning apparatus can be obtained.

Furthermore, in Embodiment 1, as shown in FIG. 6, regarding the inter-blade-ring length B in the fan rotation axis O direction, the length Bb of the inter-blade-ring center section 20*b* in the fan rotation axis O direction, each length Ba of the two blade-ring proximate sections 20*a* at both ends in the fan rotation axis O direction, and each length Bc of the two blade connection sections 20*e* in the fan rotation axis O direction hold the relationship of Bb>Ba>Bc.

If the ratio of this length Bb of the inter-blade-ring center section 20*b* to the inter-blade-ring length B is excessively high, then the flow concentrates too much in the inter-blade-ring center section, and if, conversely, the ratio is excessively low, then the noise reduction effect and the energy saving effect cannot be obtained. As such, there is an optimum range.

Figure 11:
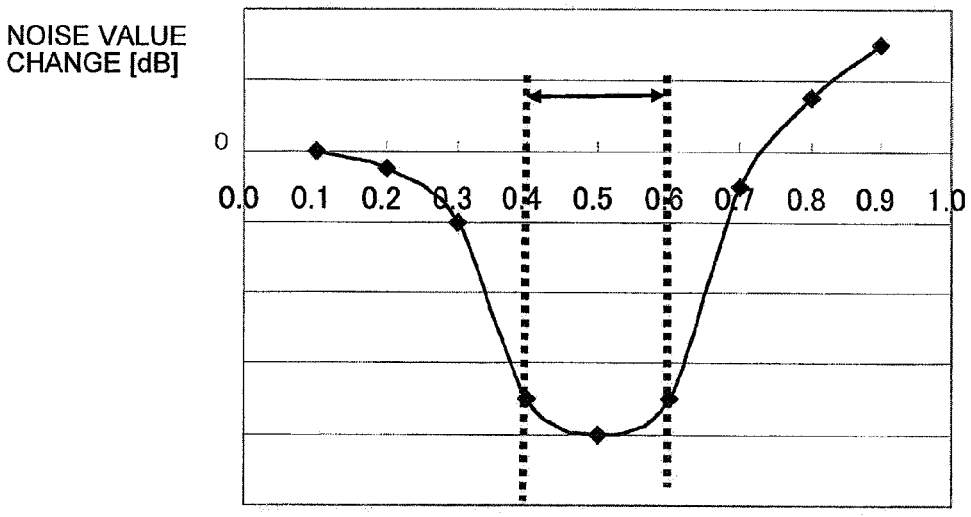
FIG. 11 is a diagram illustrating a noise value change in relation to a ratio Bb/B of a length Bb of an inter-blade-ring center section to an inter-blade-ring length B, under a constant air volume.

FIG. 11 is a diagram illustrating the noise value change in relation to a ratio Bb/B of a length Bb of an inter-blade-ring center section to an inter-blade-ring length B, under a constant air volume.

Figure 12:
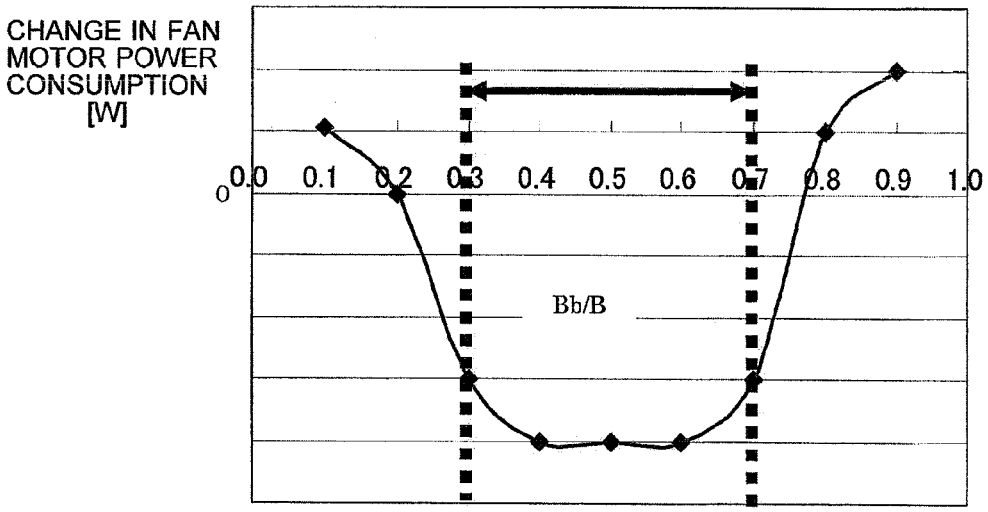
FIG. 12 is a diagram illustrating change in fan motor power consumption in relation to the ratio Bb/B under a constant air volume.

FIG. 12 is a diagram illustrating change in fan motor power consumption in relation to the ratio Bb/B under a constant air volume.

As illustrated in FIG. 11, when the ratio Bb/B of the blade 20, which is the ratio of the length Bb of the inter-blade-ring center section 20*b* in the fan rotation axis O direction to the inter-blade-ring length B in the fan rotation axis O direction, is at least between 0.4 and 0.6, then the noise reduction effect can be obtained.

Furthermore, as shown in FIG. 12, when Bb/B is at least between 0.3 and 0.7, then power consumption of the fan motor can be reduced.

Accordingly, if Bb/B is at least between 0.4 and 0.6, then the noise reduction effect and the fan-motor power-consumption reduction effect can be obtained, and thus, a quiet and high energy saving cross flow fan 8 and air-conditioning apparatus can be obtained.

Embodiment 2

Figure 13:
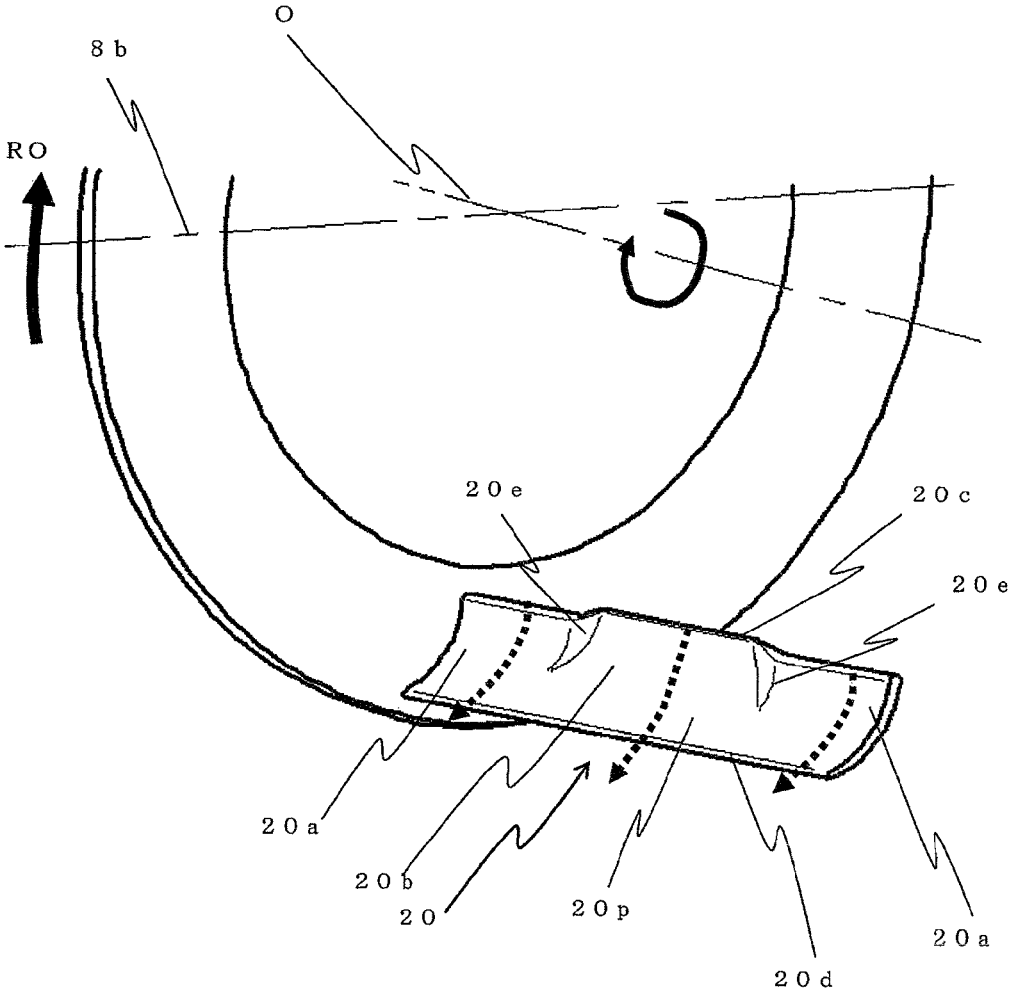
FIG. 13 is a perspective view of a cross flow fan of Embodiment 2 that corresponds to that of FIG. 4 and that is mounted to an air-conditioning apparatus.

FIG. 13 is a perspective view of a cross flow fan of Embodiment 2 that corresponds to that of FIG. 4 and that is mounted to an air-conditioning apparatus.

Figure 14:
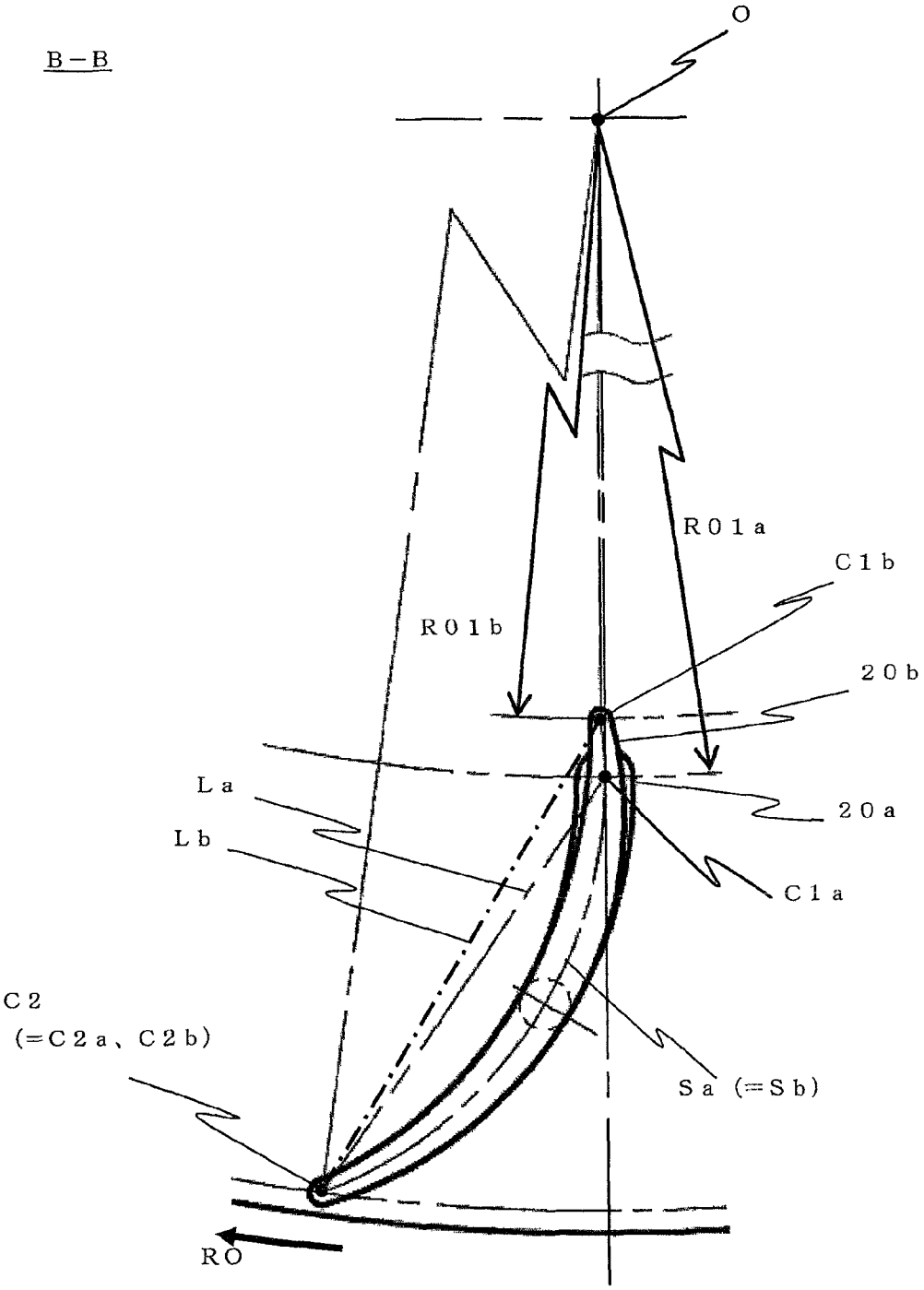
FIG. 14 is a cross-sectional view of the blade of FIG. 13 corresponding to that of FIG. 9 taken along the line B-B.

FIG. 14 is a cross-sectional view of the blade of FIG. 13 corresponding to that of FIG. 9 taken along the line B-B.

Referring to FIG. 14, a shape of the blade-ring proximate section 20*a* is shown, as well as a section of the inter-blade-ring center section 20*b* that is a section orthogonal to the fan rotation axis O.

Note that in FIG. 13 and FIG. 14, components that correspond to those in the above-described Embodiment 1 will be denoted with the same reference numerals. Hereinafter, points different from those of Embodiment 1 described above will be mainly described.

As illustrated in FIG. 13, the inner peripheral blade end 20*c* in the inter-blade-ring center section 20*b* is formed so as to protrude more to the inner peripheral side of the impeller 8*a* than the blade-ring proximate section 20*a*. That is, it has a convex shape.

Further, as illustrated in FIG. 14, the camber line Sb in the inter-blade-ring center section 20*b* is identical to the camber lines Sa in the blade-ring proximate sections 20*a*. The camber line Sb protrudes along the extension line of the camber line Sa towards the inner peripheral side of the impeller 8*a*. That is, the arc radius of the center of thickness in the inter-blade-ring center section 20*b* is formed so as to have the same arc radius as the center of thickness in the blade-ring proximate sections 20*a*.

Furthermore, the arc center point C2*a* of the outer peripheral blade end 20*da* in the blade-ring proximate section 20*a* is the same as the arc center point C2*b* of the outer peripheral blade end 20*db* in the inter-blade-ring center section 20*b*.

Further, in FIG. 14, La is the chord line of the line connecting the arc center point C1*a* of the inner peripheral blade end 20*ca* and the arc center point C2*a* of the outer peripheral blade end 20*da*, in the blade-ring proximate section 20*a*.

Furthermore, Lb is the chord line of the line connecting the arc center point C1*b* of the inner peripheral blade end 20*cb* and the arc center point C2*b* of the outer peripheral blade end 20*db*, in the inter-blade-ring center section 20*b*.

Now, the length of the chord line Lb is formed to be longer than that of the chord line La.

Further, R01*a* is the radius of a circle that is centered around the fan rotation axis O and that passes through the arc center point C1*a* of the inner peripheral blade end 20*ca* in the blade-ring proximate section 20*a*.

Further, R01*b* is the radius of a circle that is centered around the fan rotation axis O and that passes through the arc center point C1*b* of the inner peripheral blade end 20*cb* in the inter-blade-ring center section 20*b*.

Now, the blade 20 is formed such that: radius R01*a*>radius R01*b*.

As above, in Embodiment 2, the inner peripheral blade end 20*c* in the inter-blade-ring center section 20*b* is formed so as to protrude more to the inner peripheral side of the impeller 8*a* than the blade-ring proximate section 20*a*.

Accordingly, the chord length in the inter-blade-ring center section 20*b* (the length of the chord line Lb) becomes longer than the chord length in the blade-ring proximate sections 20*a* (the length of the chord line La), and thus, it is possible to allow the inter-blade-ring center section 20*b* to have a higher static pressure rise than the blade-ring proximate sections 20*a*.

Accordingly, it is possible to generate a pressure gradient from the inter-blade-ring center section 20*b* to each blade-ring proximate section 20*a* on both sides such that the pressure changes from high pressure to low pressure. As a result, it is possible to generate a flow from the inter-blade-ring center section 20*b* to each blade-ring proximate section 20*a*.

In addition to the boundary-layer turbulent flow suppressing effect in the blade-ring proximate sections 20*a* of Embodiment 1 described above, it is possible to suppress the development of the boundary layer at the surface of the ring 8*b* with the flow to the blade-ring proximate sections 20*a* from the inter-blade-ring center section 20*b*; hence, separated turbulent flow on the outlet side of the blade 20 can be further suppressed.

Accordingly, it is possible to further reduce noise, as well as reducing power consumption of the fan motor by increasing the effective air passage and, thus, reducing the air flow resistance between the blades.

Therefore, a cross flow fan 8 and air-conditioning apparatus that are even more quiet and energy saving can be obtained.

INDUSTRIAL APPLICABILITY

Not limited to the above-described air-conditioning apparatus, the cross flow fan of the invention can be effectively utilized in an air cleaner, a humidifier, a dehumidifier, or the like.

REFERENCE SIGNS LIST

1 air-conditioning apparatus body; 1*a* body front; 1*b* body upper portion; 2 upper inlet port; 3 air outlet; 4*a* vertical wind direction vane; 4*b* horizontal wind direction vane 4*b*; 5 filter; 6 front grille; 7 heat exchanger; 8 cross flow fan; 8*a* impeller; 8*b* ring; 8*c* impeller unit; 8*d* fan shaft; 8*e* fan boss; 9 stabilizer; 10 guide wall; 11 room; 11*a* wall; 12 motor; 12*a* motor shaft; 20 blade; 20*a* blade-ring proximate section; 20*b* inter-blade-ring center section; 20*c* inner peripheral blade end; 20*ca* inner peripheral blade end at the blade-ring proximate section 20*a*; 20*cb* inner peripheral blade end at the inter-blade-ring center section 20*b*; 20*d* outer peripheral blade end; 20*da* peripheral blade end at the blade-ring proximate section 20*a*; 20*db* peripheral blade end at the inter-blade-ring center section 20*b*; 20*e* blade connection section; 20*p* blade pressure surface; 20*s* blade suction pressure surface; B inter-blade-ring length; Ba length of the blade-ring proximate section 20*a*; Bb length of the inter-blade-ring center section 20*b*; Bc length of the blade connection section 20*e*; C1*a* arc center point of the inner peripheral blade end 20*ca* in the blade-ring proximate section 20*a*; C1*b* arc center point of the inner peripheral blade end 20*cb* in the inter-blade-ring center section 20*b*; C2*a* arc center point of the outer peripheral blade end 20*da* in the blade-ring proximate section 20*a*; C2*b* arc center point of the outer peripheral blade end 20*db* in the inter-blade-ring center section 20*b*; C3*a* chord center point at the blade-ring proximate section 20*a*; C3*a*' projected point of the chord center point C3*a* onto the section taken along the line B-B; E1 suction side flow path; E2 discharge side flow path; F arrow view; La chord line in the blade-ring proximate section 20*a*; Lb chord line in the inter-blade-ring center section 20*b*; Mia inter-blade distance between the inner peripheral blade ends 20*ca* in the blade-ring proximate section 20*a*; M1*b* inter-blade distance between the inner peripheral blade ends 20*cb* in the inter-blade-ring center section 20*b*; M2*a* inter-blade distance between the outer peripheral blade ends 20*da* in the blade-ring proximate section 20*a*; M2*b* inter-blade distance between the outer peripheral blade ends 20*db* in the inter-blade-ring center section 20*b*; O fan rotation axis; RO fan rotation direction; R01*a* radius of a circle that is centered around the fan rotation axis O and that passes through the arc center point C1*a* of the inner peripheral blade end 20*ca* in the blade-ring proximate section 20*a*; R01*b* radius of a circle that is centered around the fan rotation axis O and that passes through the arc center point C1*a* of the inner peripheral blade end 20*ca* in the inter-blade-ring center section 20*b*; R02*a* radius of a circle that is centered around the fan rotation axis O and that passes through the arc center point C2*a* of the outer peripheral blade end 20*da* in the blade-ring proximate section 20*a*; R02*b* radius of a circle that is centered around the fan rotation axis O and that passes through the arc center point C2*a* of the outer peripheral blade end 20*da* in the inter-blade-ring center section 20*b*; Ra1 arc radius of the blade pressure surface 20*p* in the blade-ring proximate section 20*a*; Ra2 arc radius of the blade suction pressure surface 20*s* in the blade-ring proximate section 20*a*; Ra3 arc radius of the camber line Sa in the blade-ring proximate section 20*a*, Rb1 arc radius of the blade pressure surface 20*p* in the inter-blade-ring center section 20*b*; Rb2 arc radius of the blade suction pressure surface 20*s* in the inter-blade-ring center section 20*b*; Rb3 arc radius of the camber line Sb in the inter-blade-ring center section 20*b*; Sa camber line in the blade-ring proximate sections 20*a*; Sb camber line in the inter-blade-ring center section 20*b*; Ua blowout flow from the blade-ring proximate section 20*a*; Ub blowout flow from the inter-blade-ring center section 20*b*; t1*a* thickness at the arc center point C1*a* of the inner peripheral blade end 20*ca* in the blade-ring proximate section 20*a*; t1*b* thickness at the arc center point C1*b* of the inner peripheral blade end 20*cb* in the inter-blade-ring center section 20*b*; t2*a* thickness at an arc center point C2*a* of the outer peripheral blade end 20*da* in the blade-ring proximate section 20*a*; t2*b* thickness at an arc center point C2*b* of the outer peripheral blade end 20*db* in the inter-blade-ring center section 20*b*; t3*a* thickness at the chord center point C3*a* in the blade-ring proximate section 20*a*.

The invention claimed is:

1. A cross flow fan, comprising:

an impeller including, at least two support plates arranged with intervals in a rotation axis direction, and a plurality of blades arranged between correlated support plates, the blades being arranged with intervals in a circumferential direction of the support plates, wherein each blade between the support plates is divided into a plurality of areas in the rotation axis direction such that both ends adjacent to the support plates are a first area and a center portion of the blade is a second area, a thickness of an inner peripheral blade end is formed such that the second area is smaller in thickness than the first area, an area between the first area and the second area is a third area, and a thickness of the blade in the third area is formed to gradually change in shape from a thickness of the blade in the first area to a thickness of the blade in the second area.

2. The cross flow fan of claim 1, wherein a thickness of the blade in the first area is formed so as to become gradually thicker from an outer peripheral blade end that is an end of the blade on an outer-circumferential side of the impeller to the inner peripheral blade end.

3. The cross flow fan of claim 1, wherein, the thickness of the blade in the second area is formed so as to become gradually thinner to an inner peripheral blade end that is an end of the blade on an inner-circumferential side of the impeller after the thickness of the blade in the second area is formed so as to become gradually thicker from an outer peripheral blade end that is an end of the blade on an outer-circumferential side of the impeller to the inner peripheral blade end.

4. The cross flow fan of claim 1, wherein the thickness of the blade in the second area is formed so as to become gradually thicker from an outer peripheral blade end to the middle of the outer peripheral blade end and an inner peripheral blade end and is formed so as to become gradually thinner from the middle to the inner peripheral blade end.

5. The cross flow fan of claim 1, wherein, each blade is formed such that a section orthogonal to the rotation axis is an arc shape, and when an intersection point between a perpendicular bisector of a chord line connecting an outer peripheral blade end and the inner peripheral blade end, and a center of thickness of the blade is referred to as a chord center point, the thickness of each blade in the first area is formed such that: the thickness of the outer peripheral blade end<the thickness at the chord center point<thickness of the inner peripheral blade end, and the thickness of each blade in the second area is formed such that: thickness of the outer peripheral blade end<the thickness at the chord center point, and, the thickness at the chord center point>thickness of the inner peripheral blade end.

6. The cross flow fan of claim 1, wherein, each blade is formed such that the section orthogonal to the rotation axis is the arc shape, in the first area, an arc radius of a blade pressure surface that is a front surface with respect to a rotation direction of the blades is formed so as to be smaller than an arc radius of a blade suction pressure surface that is a rear surface with respect to the rotation direction of the blades, and in the second area, the arc radius of the blade pressure surface is formed so as to be larger than the arc radius of the blade suction pressure surface.

7. The cross flow fan of claim 1, wherein in each area of the blade, a shape of a section orthogonal to the rotation axis is formed such that the shape in each area is identical from an outer peripheral blade end to the middle of the outer peripheral blade end and an inner peripheral blade end, and the shape in each area varies from the middle of the outer peripheral blade end and the inner peripheral blade end to the inner peripheral blade end.

8. The cross flow fan of claim 1, wherein the inner peripheral blade end in the second area is formed so as to protrude more to an outer-circumferential side of the impeller than the first area.

9. The cross flow fan of claim 8, wherein, each blade is formed such that the section orthogonal to the rotation axis is the arc shape, and an arc radius of a center of thickness in the second area is formed so as to have an arc radius equivalent to a center of thickness in the first area.

10. The cross flow fan of claim 1, wherein a ratio (Bb/B) of a length (Bb) of the second area in the rotation axis direction to a total length (B) of the blade in the rotation axis direction is formed to be between 0.4 and 0.6.

11. The cross flow fan of claim 1, wherein the ratio (Bb/B) of the length (Bb) of the second area in the rotation axis direction to the total length (B) of the blade in the rotation axis direction is formed to be between 0.3 and 0.7.

12. An air-conditioning apparatus, comprising:

a cross flow fan, including, an impeller having, at least two support plates arranged with intervals in a rotation axis direction, and a plurality of blades arranged between correlated support plates, the blades being arranged with intervals in a circumferential direction of the support plates, wherein each blade between the support plates is divided into a plurality of areas in the rotation axis direction such that both ends adjacent to the support plates are a first area and a center portion of the blade is a second area, a thickness of an inner peripheral blade end is formed such that the second area is smaller in thickness than the first area, an area between the first area and the second area is a third area, and a thickness of the blade in the third area is formed to gradually change in shape from a thickness of the blade in the first area to a thickness of the blade in the second area; and a heat exchanger disposed in a suction-side passage formed by the cross flow fan, the heat exchanger being configured to exchange heat with sucked-in air.

13. The air-conditioning apparatus of claim 12, wherein the thickness of the blade in the first area is formed so as to become gradually thicker from an outer peripheral blade end that is an end of the blade on an outer-circumferential side of the impeller to the inner peripheral blade end.

14. The air-conditioning apparatus of claim 12, wherein the thickness of the blade in the second area is formed so as to become gradually thinner to an inner peripheral blade end that is an end of the blade on an inner-circumferential side of the impeller after the thickness of the blade in the second area is formed so as to become gradually thicker from an outer peripheral blade end that is an end of the blade on an outer-circumferential side of the impeller to the inner peripheral blade end.

15. The air-conditioning apparatus of claim 12, wherein the thickness of the blade in the second area is formed so as to become gradually thicker from an outer peripheral blade end to the middle of the outer peripheral blade end and the inner peripheral blade end and is formed so as to become gradually thinner from the middle to the inner peripheral blade end.

16. The air-conditioning apparatus of claim 12, wherein each blade is formed such that a section orthogonal to the rotation axis is an arc shape, and when an intersection point between the perpendicular bisector of a chord line connecting an outer peripheral blade end and the inner peripheral blade end, and a center of thickness of the blade is referred to as a chord center point, the thickness of each blade in the first area is formed such that: the thickness of the outer peripheral blade end<the thickness at the chord center point<thickness of the inner peripheral blade end, and the thickness of each blade in the second area is formed such that: thickness of the outer peripheral blade end<the thickness at the chord center point, and, the thickness at the chord center point>thickness of the inner peripheral blade end.

17. The air-conditioning apparatus of claim 12, wherein each blade is formed such that a section orthogonal to the rotation axis is the arc shape, in the first area, an arc radius of a blade pressure surface that is a front surface with respect to a rotation direction of the blades is formed so as to be smaller than an arc radius of a blade suction pressure surface that is a rear surface with respect to the rotation direction of the blades, and in the second area, the arc radius of the blade pressure surface is formed so as to be larger than the arc radius of the blade suction pressure surface.

18. The air-conditioning apparatus of claim 12, wherein in each area of the blade, a shape of the section orthogonal to the rotation axis is formed such that the shape in each area is identical from an outer peripheral blade end to the middle of the outer peripheral blade end and the inner peripheral blade end, and the shape in each area varies from the middle of the outer peripheral blade end and the inner peripheral blade end to the inner peripheral blade end.

* * * * *